US008453800B2

(12) United States Patent
Tolonen

(10) Patent No.: US 8,453,800 B2
(45) Date of Patent: Jun. 4, 2013

(54) ELEVATOR AND STOP BLOCK ARRANGEMENT FOR AN ELEVATOR

(75) Inventor: Teemu Tolonen, Aura (FI)

(73) Assignee: Kone Corporation, Helsinki (FI)

( * ) Notice: Subject to any disclaimer, the term of this patent is extended or adjusted under 35 U.S.C. 154(b) by 387 days.

(21) Appl. No.: 12/818,729

(22) Filed: Jun. 18, 2010

(65) Prior Publication Data

US 2010/0252369 A1 Oct. 7, 2010

Related U.S. Application Data

(63) Continuation of application No. PCT/FI2008/000134, filed on Nov. 27, 2008.

(30) Foreign Application Priority Data

Dec. 21, 2007 (FI) ..... 20071014

(51) Int. Cl.
*B66B 5/26* (2006.01)
*B66B 5/16* (2006.01)
*B66B 11/02* (2006.01)

(52) U.S. Cl.
USPC ..... 187/360; 187/357; 187/359; 187/401

(58) Field of Classification Search
USPC ..... 187/360, 357, 359, 401
IPC ..... B66B 5/00
See application file for complete search history.

(56) References Cited

U.S. PATENT DOCUMENTS 286,760 A * 10/1883 Bachmann ..... 187/313
311,783 A * 2/1885 Rau et al. ..... 187/359
483,145 A * 9/1892 Giles ..... 187/360
630,424 A * 8/1899 Terry et al. ..... 187/365

(Continued)

FOREIGN PATENT DOCUMENTS

EP 1 473 264 A1 11/2004
EP 1 604 934 A1 12/2005

(Continued)

OTHER PUBLICATIONS

FR2795060 English Translation.pdf.*

(Continued)

*Primary Examiner* — Michael Mansen
*Assistant Examiner* — Minh Truong
(74) *Attorney, Agent, or Firm* — Birch, Stewart, Kolasch & Birch, LLP

(57) ABSTRACT

An elevator, comprising an elevator car (1), car guide rails (3) on one side of the elevator car (1), an elevator shaft or equivalent (5), at least one stop block (9) attached to the car guide rails (3) or to the elevator shaft or equivalent (5), at least two movable stop blocks (7) attached to the elevator car (1), the latter stop blocks (7) being arranged to be moved transversely relative to the elevator shaft direction into a position aligned with at least one stop block (9) attached to the car guide rails (3) or elevator shaft or equivalent (5) and away from said position aligned with said stop block (9). The aforesaid at least two movable stop blocks (7) attached to the elevator car are connected to each other by a horizontal shaft (10) oriented substantially in a direction parallel with the wall of the elevator car (1) on the side of the car guide rails (3) to synchronize the motion of the movable stop blocks (7).

20 Claims, 3 Drawing Sheets

U.S. PATENT DOCUMENTS

| | | | | | |
|---|---|---|---|---|---|
| 652,118 | A | * | 6/1900 | Kimball | 187/378 |
| 667,780 | A | * | 2/1901 | Jelinek | 187/360 |
| 684,013 | A | * | 10/1901 | Warren | 187/360 |
| 693,212 | A | * | 2/1902 | Bainbridge | 187/360 |
| 733,907 | A | * | 7/1903 | Hanson et al. | 187/360 |
| 799,834 | A | * | 9/1905 | Crump | 187/359 |
| 823,455 | A | * | 6/1906 | Willcox | 187/359 |
| 846,807 | A | * | 3/1907 | Thornber | 187/371 |
| 887,193 | A | * | 5/1908 | Heiling | 187/365 |
| 1,109,693 | A | * | 9/1914 | Morris | 188/63 |
| 1,773,163 | A | * | 8/1930 | Becker | 187/360 |
| 5,411,117 | A | * | 5/1995 | Hayrinen | 187/360 |
| 7,258,202 | B1 | * | 8/2007 | Rossignol | 187/351 |
| 7,407,041 | B2 | * | 8/2008 | Jungbauer et al. | 187/401 |
| 2007/0034455 | A1 | * | 2/2007 | Coquerelle et al. | 187/414 |

FOREIGN PATENT DOCUMENTS

| | | | | |
|---|---|---|---|---|
| EP | 1 674 416 | A1 | | 6/2006 |
| FR | 2 795 060 | A1 | | 12/2000 |
| JP | 2005343579 | A | * | 12/2005 |
| WO | 2005/032992 | A1 | | 4/2005 |

OTHER PUBLICATIONS

JP2005343579 English Translation.pdf.*

* cited by examiner

ELEVATOR AND STOP BLOCK ARRANGEMENT FOR AN ELEVATOR

CROSS REFERENCE TO RELATED APPLICATIONS

This application is a Continuation of PCT International Application No. PCT/FI2008/000134 filed on Nov. 27, 2008, which claims the benefit of Patent Application No. 20071014 filed in Finland, on Dec. 21, 2007. The entire contents of all of the above applications is hereby incorporated by reference into the present application.

FIELD OF THE INVENTION

The present invention relates to an elevator and to an elevator stop block arrangement.

BACKGROUND OF THE INVENTION

There are many different prior-art elevator safety devices that can be used to create a temporary safety space in an end portion of an elevator shaft. The commonest arrangement for accomplishing this is to use mechanical stop blocks arranged to stop the elevator car and prevent it from reaching the extremity of the elevator shaft. A proposed solution for implementing this is to use e.g. a mechanical stop block attached to the elevator shaft and arranged to be moved into the path of a mechanical stop block attached to the elevator car. There are also arrangements for providing a safe space for a serviceman above an elevator car where a stopper attached to the elevator car can be activated by the serviceman by temporarily moving the stopper into a position such that the stopper is set in alignment with a stopper provided in the elevator shaft. In the above-described solutions, the elevator car can only move until the mutually aligned stoppers meet, whereafter the elevator car is unable to move further. In this way, elevator car movement can be restricted for the time during which a serviceman is working e.g. on the top of the elevator car. Otherwise the serviceman would be exposed to the risk of being caught between the elevator car and the end of the elevator shaft. Prior-art technology is described in patent specifications EP1473264, EP1604934, EP1674416A1 and FR2795060A1, among others.

The problems encountered in prior-art solutions include the facts that each stopper has to be activated separately, the stoppers are difficult to activate from a landing door without stepping onto the top of the elevator car, the solutions are complicated and take up plenty of space, a separate limit switch must be provided for each movable stopper and the safety devices are slow and unsafe to activate.

OBJECT OF THE INVENTION

The object of the invention is to overcome i.a. the above-mentioned drawbacks of prior-art solutions and to produce an elevator with improved safety equipment and an improved stop block arrangement for an elevator. The aim of the invention is to achieve one or more of the following advantages, among others:

- a safe space at one end of an elevator shaft, preferably especially a safe space above the elevator car
- safe and simple simultaneous activation of car stoppers
- activation of several stoppers at a time
- reduced number of limit switches required
- a narrow safety device structure, which is particularly advantageous in the case of ruck-sack type elevators, because the safety device structure can be installed on the elevator car in the area on the side of the guide rails, requiring only a small space in that area
- a safety device structure requiring only a small space in the transverse direction of the elevator shaft
- an adjustable stopper structure in which the position of the stop face in the elevator shaft can be adjusted as desired
- an adjustable stopper structure that reduces the significance of measurement errors in the mounting of the stop block, thus allowing the mounting holes, slots or other shapes required for the mounting e.g. on the guide rail to be made already in factory, because the stop faces can be positioned on site as desired by utilizing the adjustability provided in the stop block to compensate for a measurement error in the disposition of holes or equivalent in the guide rail. The stopper structure is therefore particularly well suited for use e.g. as counter stoppers for stoppers connected by synchronization, because it is difficult adjust the mutual positions of synchronized stoppers.
- an elevator and a stop block arrangement for an elevator wherein the safety device can be safely activated. Especially in the case of ruck-sack type elevators with landing doors in an elevator shaft wall adjacent to the guide-rail side wall, a serviceman is able to activate a number of stoppers without stepping onto the top of the car, no matter from which side of the car he opens the landing door.
- an elevator and a stop block arrangement for an elevator with a good space utilization efficiency.

BRIEF DESCRIPTION OF THE INVENTION

Inventive embodiments are presented in the description part and drawings of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. The features of different embodiments of the invention may be applied in connection with other embodiments within the scope of the basic inventive concept.

The elevator of the invention comprises an elevator car, car guide rails on one side of the elevator car, an elevator shaft or equivalent, at least one stop block attached to the car guide rails or to the elevator shaft or equivalent, at least two movable stop blocks attached to the elevator car, the latter stop blocks being arranged to be moved transversely relative to the elevator shaft into a position aligned with at least one stop block attached to the car guide rails or elevator shaft or equivalent and away from said aligned position. The aforesaid at least two movable stop blocks attached to the elevator car are connected to each other by a horizontal synchronizing element, preferably a shaft, connected to the stop blocks, said element being oriented substantially in a direction parallel with the elevator car wall on the side facing the car guide rails, to synchronize the motion of the movable stop blocks. With this arrangement, efficient space utilization and a safe structure capable of fast operation are achieved. In addition, as the guide rails and safety device are disposed on one side of the transverse cross-section of the elevator shaft as far as possible, there remains, at least on one side of the area on the top of the elevator car, free space where safe working is possible. Thus, the safety device as well as many of the machine components causing danger are concentrated on one side of the car, so they can be observed simultaneously.

In an embodiment of the invention, the elevator comprises two car guide rails disposed on one side of the elevator car, each guide rail having a stop block attached to it, and the two movable stop blocks attached to the elevator car are arranged to be moved transversely relative to the elevator shaft into a position aligned with the aforesaid stop blocks attached to the car guide rails and away from said aligned position, which two movable stop blocks attached to the elevator car are connected to each other by a horizontal shaft oriented substantially in a direction parallel with the elevator car wall on the side facing the car guide rails to synchronize the motion of the movable stop blocks. The advantages include a simple, safe and compact structure. The stop blocks can inter alia be advantageously positioned interjacently with other elevator components.

In an embodiment of the invention, the stop blocks are arranged to be moved in a transverse direction of the elevator shaft towards the car guide rails to an activated position and in a direction away from the car guide rails to a deactivated position.

In an embodiment of the invention, the aforesaid at least two movable stop blocks attached to the elevator car are turnable about parallelly oriented fulcrums and fixedly connected to each other by a shaft, preferably a metal rod or metal tube, attached to the stop blocks and oriented in the same direction with the fulcrums of the stop blocks.

In an embodiment of the invention, the aforesaid at least two movable stop blocks attached to the elevator car are turnable about a horizontal fulcrum. This provides the advantage of fast, safe and simple activation, inter alia.

In an embodiment of the invention, the synchronizing shaft is coaxial with the fulcrums of the aforesaid at least two stop blocks attached to the elevator car. This provides the advantage that the safety device can be accommodated in a narrow space on the car.

In an embodiment of the invention, the aforesaid at least two stop blocks attached to the elevator car are placed on the top of the elevator car. This provides the advantage that the stop blocks can be activated easily and regardless of where in the shaft the elevator car is located.

In an embodiment of the invention, the aforesaid at least one stop block attached to the car guide rails or elevator shaft or equivalent is attached to the car guide rails. An advantage of this is that the stop block can be positioned at exactly the desired point in the elevator shaft.

In an embodiment of the invention, the aforesaid at least two stop blocks attached to the elevator car are arranged to be turned into their activated position by a swiveling motion over the fulcrum. This structure provides safety especially as regards the safety space above the elevator car, because in the event of a collision the stop blocks in the elevator shaft press the car stoppers towards the activated position.

In an embodiment of the invention, the elevator car comprises a buffer placed in the path of the aforesaid at least two stop blocks attached to the elevator car to limit their turning movement. One of the advantages of this is that, when hitting the fixed stopper, the movable stopper will not turn away from the active position.

In an embodiment of the invention, the aforesaid at least two turnable stop blocks attached to the elevator car are so mounted on the elevator car that the synchronizing shaft is between the elevator car and the elevator shaft and/or under the elevator car. With this arrangement, a space saving on the top of the elevator car and efficient space utilization in the transverse direction of the elevator shaft are achieved, inter alia.

In an embodiment of the invention, the aforesaid at least one stop block attached to the car guide rails or to the elevator shaft or equivalent comprises at least one adjustable stop block. This allows the stop blocks attached to the elevator car to be easily caused to meet the stop blocks in the elevator shaft simultaneously. In addition, this reduces the significance of small measurement errors in the mounting of the stop blocks, so the positions of the stop block mountings can be machined already in factory.

In an embodiment of the invention, the aforesaid at least one stop block attached to the car guide rails or to the elevator shaft or equivalent comprises a first stopper element and a second stopper element, these two stopper elements being movable relative to each other to allow adjustment of the mutual positions of the stopper elements. This structure is safe and permits fast adjustment of the stop block.

In an embodiment of the invention, the stop block comprises means for fastening the first and second elements so as to make them immovable relative to each other.

In an embodiment of the invention, the first element and the second stopper element comprise form-locking surfaces, such as e.g. cogged surfaces. The structure in question is safe and permits fast adjustment of the stop block.

In an embodiment of the invention, the stop block and/or buffer comprise/comprises an impact damper element made of elastic material, such as e.g. rubber. This reduces the effect of measurement errors and softens the impact.

In an embodiment of the invention, the elevator comprises two stop blocks attached to the car guide rails or elevator shaft or equivalent, of which two stop blocks only one is adjustable, which enables the number of complex structures to be kept small.

In an embodiment of the invention, the motor and the hoisting ropes are disposed on the same side of the elevator shaft as the car guide rails, preferably between the car guide rails. In this way, efficient space utilization and a one-sided structure are achieved, so a serviceman can safely work in the elevator car area opposite to the machine and safety device, where there is enough space.

In an embodiment of the invention, the elevator concerned is an elevator without counterweight. In this case, the stop blocks can be designed to smaller dimensions than in counterweighted elevators.

In an embodiment of the invention, the turnable shaft is mounted to be supported by the car frame, i.e. car sling, by at least one, preferably two horizontal beams of the car frame 16 preferably on the top of the car, said horizontal beam/beams being preferably oriented at right angles to said shaft. The advantages include a reliable support of the stop block in an impact situation. A further advantage is that the forces produced by the impact are distributed uniformly to the more solid structures and the risk of damage to the elevator car is reduced.

In an embodiment of the invention, at least part of the elevator hoisting ropes are guided to pass via an area which, in a first horizontal direction, is delimited between an outer wall of the elevator car and an inner surface of the elevator shaft and, in a second horizontal direction, between the two guide rails of the elevator car. The advantages include a compact and safe structure. The stopper structure and the synchronizing element are effectively distributed among the elevator components between the guide rails.

The stop block arrangement of the invention in an elevator, said elevator comprising an elevator car, car guide rails disposed on one side of the elevator car and an elevator shaft or equivalent, comprises two stop blocks placed separately at a distance from each other and secured on the side of the elevator car facing towards the car guide rails to the car guide rails or elevator shaft or equivalent, two movable stop blocks attached to the elevator car, the latter stop blocks being arranged to be moved transversely relative to the elevator shaft into a position aligned with the stop blocks attached to the car guide rails or elevator shaft or equivalent and away from said aligned position, which two movable stop blocks attached to the elevator car are connected to each other by synchronizing means to synchronize the motion of the aforesaid movable stop blocks. The advantages of this include the fact that the stop block arrangement is safe to use and efficient in respect of space utilization, because the stop blocks are disposed on the same side as the guide rails. In addition, when the stop blocks collide, the forces produced by the impact are distributed in an advantageous uniform manner on the elevator car.

In an embodiment of the invention, the synchronizing means comprise an elongated synchronizing element, preferably a horizontal shaft substantially oriented in a direction parallel to the elevator car wall on the side facing towards the car guide rails of the elevator car, said shaft being arranged to be turnable about a fulcrum. This provides the advantage that the arrangement is safe, because many of the machine components causing danger are concentrated on one side of the car, allowing them to be observed simultaneously.

In an embodiment of the invention, at least some of the ropes in the set of hoisting ropes of the elevator are guided to pass via an area which, in a first horizontal direction, is delimited between an outer wall of the elevator car and an inner surface of the elevator shaft and, in a second horizontal direction, between the two guide rails of the elevator car. The advantages include a compact and safe structure. The stopper structure and the synchronizing element are effectively distributed among the elevator components between the guide rails.

LIST OF FIGURES

In the following, the invention will be described in detail by referring to embodiment examples and the attached drawings, wherein FIG. 1 presents a diagrammatic three-dimensional top view of the elevator of the invention.

FIG. 2 presents a side-view diagram visualizing the operating principle of the elevator of the invention.

DETAILED DESCRIPTION OF THE INVENTION

Figure 1:
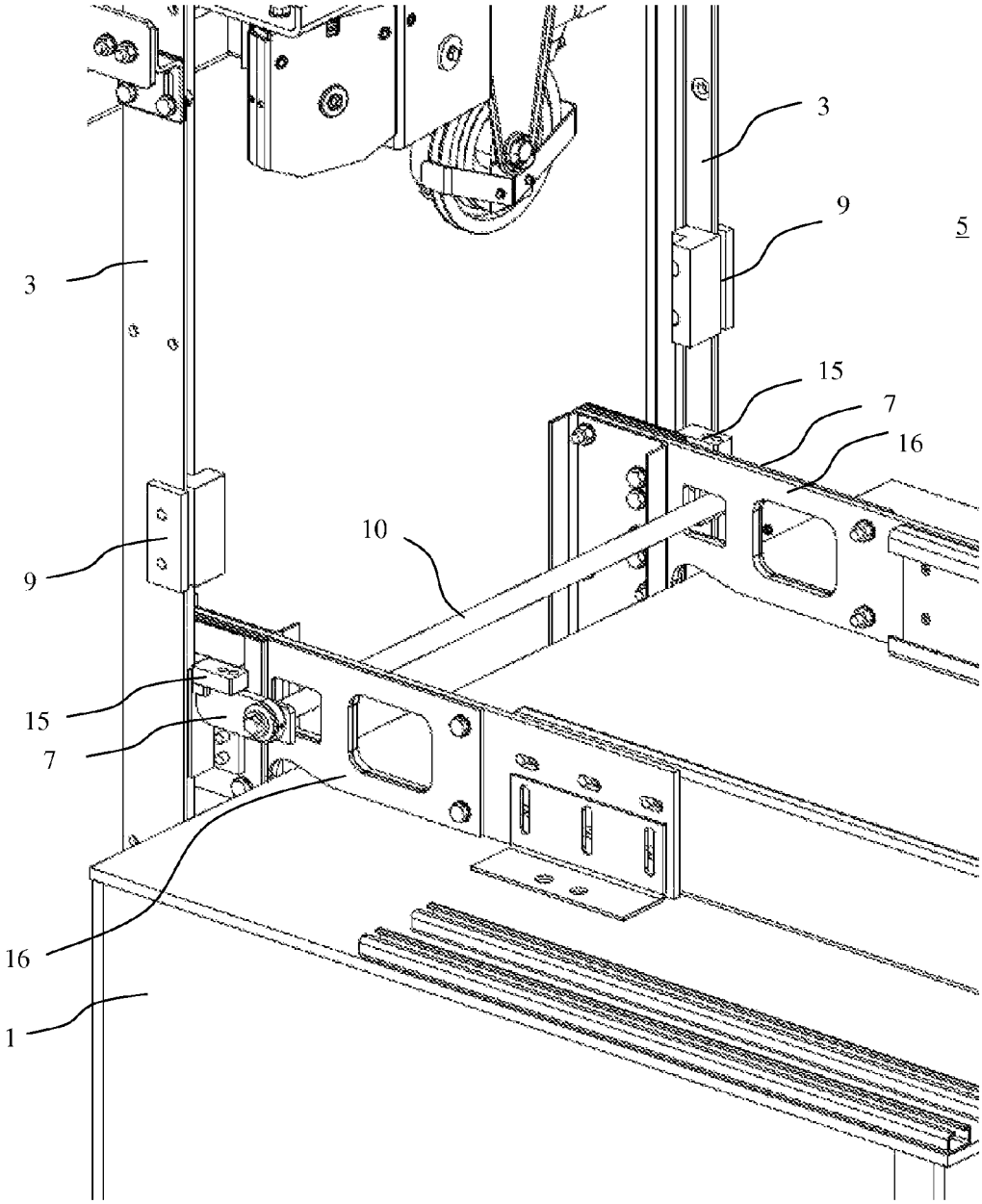

FIG. 1 represents an elevator according to an embodiment of the invention. The elevator is a ruck-sack type passenger elevator in which the car guide rails 3 are disposed on one side of the elevator car and the elevator comprises a safety device arrangement wherein two mutually identical stop blocks 7 attached to the elevator car 1 can each be moved in a transverse direction of the elevator shaft 5 into a position aligned with two stop blocks 9 immovably fixed to the car guide rails. The figure represents a situation where the stop blocks are in an activated position I, in other words, they have been moved e.g. by a serviceman to a position where they are in alignment with stop blocks 9 as seen from the end of the elevator shaft, stop blocks 9 being thus in the path of stop blocks 7, stopping the motion of stop blocks 7 and therefore also of the elevator car 1. Correspondingly, the safety arrangement can be deactivated by moving stop blocks 7 farther away from the guide rails 3 by swinging them over their fulcrum away from the position aligned with stop blocks 9, thus permitting unrestricted motion of the elevator car again. The stop blocks 7 are moved by a serviceman by turning the shaft 10 about its fulcrum or by grasping one of the stop blocks 7 and manually moving it to the desired position I or II. The motion of the stop block 7 is synchronized to be transmitted to the other stop block 7 by the shaft 10, which functions as a synchronizing element and is fixedly attached to both of the two mutually identical stop blocks 7. The movable stop blocks 7 are turnable about fulcrums oriented in the same direction, and the shaft 10 connecting them is oriented in the same direction with the fulcrums of the stop blocks 7. In the figure, the bearings and mounting of the shaft 10 on the elevator car are not shown, but these can be implemented by applying a prior-art method for effecting the mounting of a shaft. The shaft 10 is mounted in a manner permitting a swinging motion, using e.g. bearings as mentioned above, on the car frame or sling 16, on the two horizontal beams of the car frame extending at a distance from each other along the car top structure. The horizontal beams are preferably at right angles to the aforesaid shaft. One of the advantages is reliable support of the stop block in an impact situation. Being synchronized by the shaft 10, the two mutually identical stop blocks 7 move simultaneously and through identical paths of motion. The shaft 10 extends horizontally and substantially in a direction parallel with the wall of the elevator car 1 on the side of the car guide rails 3. In other words, the shaft 10 is oriented in a direction parallel with the plane determined by the guide rail pair. In addition, the shaft 10 is disposed substantially on that side of the elevator car which faces towards the guide rails 3, near the edge of the car. In the figure, the shaft 10 is placed on the top of the elevator car, which is advantageous from the point of view of maintenance operation, but the shaft could alternatively be placed below the elevator car 1 and/or between the elevator car wall facing towards the guide rails and the elevator shaft wall with the guide rails mounted on it, and/or at least partially between the guide rails.

The swinging motion of the stop blocks 7 can be advantageously limited by means of buffer parts 11 (not shown in FIG. 1) attached to the elevator car, against which buffer parts 11 stop blocks 7 lean in the active position I and which buffer parts 11 stop the motion of stop blocks 7 when these meet stop blocks 9. The operating principle of the buffer parts 11 is visualized in FIG. 2.

In the embodiment illustrated in FIG. 1, stop blocks 7 further comprise an impact absorber part 15, which may be made of rubber or some other elastic material, to dampen the impact between the stop blocks. Impact absorber parts 15 may alternatively or additionally be provided on stop blocks 9 or on the buffers of stop blocks 7. Stop blocks 9 are preferably disposed separately at a distance from each other as shown in FIG. 1, one of the advantage of which is that, when they are hit by the stop blocks of the elevator car, the forces produced by the impact are more evenly distributed on the elevator car. Moreover, this allows other components, such as e.g. hoisting ropes, to be installed between the stop blocks.

Figure 2:
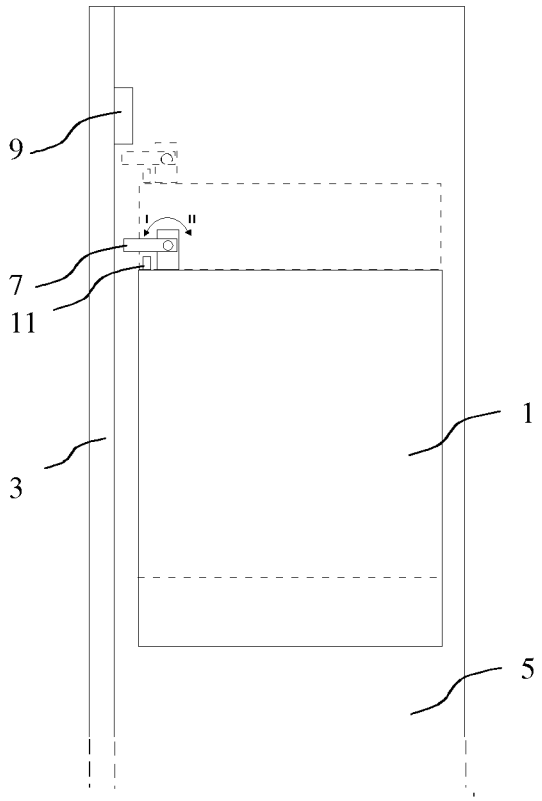

FIG. 2 is a diagrammatic side-view illustration visualizing the operating principle of the elevator represented by FIG. 1. The figure shows the stop blocks 7 of the safety device in an activated state, which permits the elevator car to be moved in the elevator shaft e.g. in maintenance operation mode without the risk of a serviceperson being caught between the car and the ceiling. In the figure, the highest possible position of the elevator car 1 when the stop blocks 7 are in the activated state is depicted with a broken line. Above the elevator car 1 there remains a temporary safety space between the top of the elevator car 1 and the ceiling of the elevator shaft 5. In the arrangement illustrated in FIG. 2, stop blocks 7 are moved between the activated position I and the deactivated position II by swinging the stop blocks 7 over their fulcra as indicated by the arrow to a position aligned with stop blocks 9 or correspondingly away from said aligned position, the stop blocks being thus moved in a direction either towards or away from the car guide rails, i.e. towards or away from the imaginary vertical plane defined by the guide rails. In their active position, the stop blocks 7 lean against the buffer parts 11, which stop the motion of stop blocks 7 when stop block 9 meets stop blocks 7. A limit switch/switches may be provided in conjunction with one of the buffer parts 11 to observe the position of stop blocks 7. The synchronizing shaft provides the advantage that the position of only one stop block 7 needs to be observed by a limit switch, because both stop blocks 7 are always in the same position. The limit switch may be any prior-art switch applicable for the purpose and it is preferably arranged to transmit data indicating the position of the limit switch to the elevator control system. When the data transmitted by the limit switch indicates that the stop blocks 7 are in the active position, preferably only maintenance operation is enabled.

Figure 3:
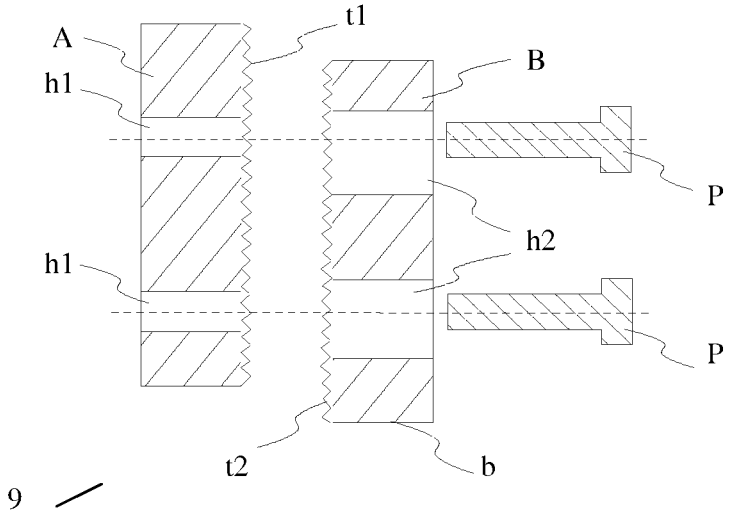
FIG. 3 is a diagrammatic representation of the adjustable stop block structure of the invention.

FIG. 3 presents cross-sectional view of a preferred structure of stop block 9 as seen from a lateral direction when the stop block is in the same position as in its intended environment of application. This structure makes it possible to produce an adjustable stop block structure that is applicable for use in the elevators presented in FIGS. 1 and 2 as well as in other embodiments described in the present application, and likewise in any prior-art elevator. The structure in question is particularly well suited for utilization in elevators having more than one stationary stop block in the elevator shaft, because the adjustability allows the stop block pairs to be adjusted to meet simultaneously. This structure is at its most advantageous in the case of an elevator in which two adjustable stop blocks fixedly mounted in the elevator shaft are to meet synchronized stop blocks mounted on the elevator car, because the position of the synchronized stop blocks would be difficult to adjust.

In the embodiment according to FIG. 3, stop block 9 has been implemented as an adjustable stop block that comprises a first stopper element A and a second stopper element B, these first and second stopper elements being movable relative to each other so as to allow adjustment of the mutual positions of the stopper elements A and B. Thus, the exact position of the stop face b of the stop block 9 in the elevator shaft 5 can be adjusted on site as desired. One of the advantages of the adjustability of the stop block 9 is that its mounting position need not be determined with a great accuracy of measurement. This again means inter alia that, if the stop blocks 9 are to be secured to the guide rails, the mounting holes can be drilled in the guide rails already in factory, so this operation need not be performed on site.

The stop block 9 further comprises means (t1, t2, P, h1, h2) for fixing the first part A and the second part B immovably relative to each other. The first part A and the second part comprise each a form that permits form locking, said forms being counter pairs for each other. In the embodiment in FIG. 3, the form-locking property is accomplished by means of serrations $t_1$ and t2. The mutual positions of the stopper elements A and B can be adjusted by setting stop face b to a desired point in the elevator shaft, placing part A against part B at a suitable position and locking the parts immovably relative to each other by tightening them against each other by means of bolts P. The bolts P are preferably long enough to extend through the holes h1 in stopper element A and secure the stopper elements A and B in place e.g. on a guide rail by engaging holes in the guide rail. Stopper element B naturally also comprises holes h2, which holes h2 preferably extend in the vertical direction of the stopper element B through a distance corresponding to the desired range of adjustment, so that the holes h2 form elongated slot-like openings in the stopper element B, against the edges of which slots the tightening force of the bolts P can be applied e.g. with or without washers.

The elevator preferably comprises two stop blocks 9 adjustable in the manner described above. On the other hand, if structural simplicity is to be maximized, then it is preferable to adapt the elevator to comprise two stop blocks 9 secured to the car guide rails 3 or elevator shaft or equivalent 5, of which two stop blocks 9 only one is adjustable and thus e.g. comprises a first stopper element A and a second stopper element B, which first and second stopper elements are movable relative to each other so as to allow adjustment of their mutual positions. In this case, the two stop blocks 7 secured to the elevator car 1 can be adapted to meet the stop blocks 9 in the elevator shaft by adjusting only one adjustable stop block 9.

Figure 4:
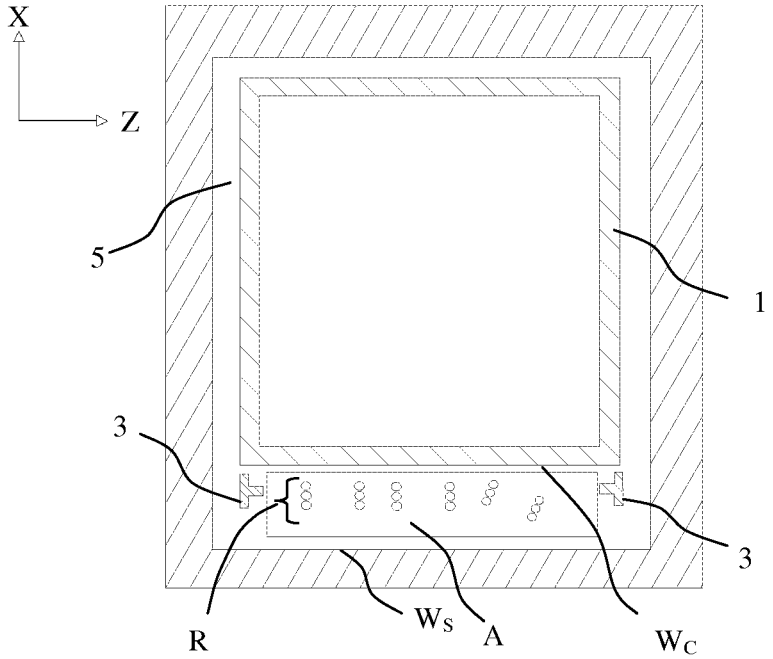
FIG. 4 shows a preferable elevator cross-section for the elevator represented by FIGS. 1 and 2.

FIG. 4 visualizes an advantageous way of arranging the elevator represented by FIGS. 1 and 2. The figure presents a cross-sectional top view with the elevator car 1 in focus. The ropes R in the set of hoisting ropes used to move the elevator car have been arranged to run through zone A, which zone A is delimited in a first horizontal direction X between an exterior wall $W_C$ of the elevator car 1 and an interior wall $W_S$ of the elevator shaft 5 and in second horizontal direction Z between the two guide rails 3 of the elevator car. The above-described synchronized stop block structure is particularly well applicable for use in an elevator arranged in this manner. The advantages include a compact and safe structure. The stop block structure and the synchronization arrangement do not involve any risk of a person stumbling on them as they are thus outside the area through which the elevator shaft is generally accessed. A further advantage is that the stop block structure and the synchronizing element are effectively interleaved with the elevator components disposed between the guide rails. In a preferred case, there are no elevator hoisting ropes running outside zone A in the elevator cross-section as seen from this point. The guide rails 3 can be placed at a desired distance from the interior wall of the elevator shaft 5.

It is obvious to a person skilled in the art that the invention is not limited to the embodiments described above, in which the invention has been described by way of example, but that many variations and different embodiments of the invention are possible within the scope of the inventive concept defined in the claims presented below. Thus, the stop blocks may also be arranged to be movable transversely relative to the elevator shaft in other ways than those illustrated in the figures, e.g. in such a way that the horizontal shaft 10 disposed in the above-described manner in relation to the elevator car actuates stoppers turnable about a vertical axis or e.g. slider-type stoppers movable back-and-forth in a transverse direction of the elevator shaft. The motion of the stoppers and horizontal shaft may be transmitted e.g. by levers. An advantage provided by these solutions would be that identical safety devices could be used both above and below in the elevator shaft. It is also obvious that the arrangement illustrated inter alia in FIG. 1 does not necessarily require simultaneous presence of all the structures. It is likewise obvious that stop block 9 could be implemented in a form differing from that described and that it may also function in such a way that both stoppers 7 meet the same stop block, which is e.g. a horizontal beam in the elevator shaft. It is also obvious that stop block 9 may be secured to any fixed stationary structure functionally corresponding to the elevator shaft, such as e.g. a wall of the building or a guide rail mounting bracket. It is further obvious that the stop block arrangement of the invention can also be utilized in other than ruck-sack type elevators. In addition, it is obvious that the shaft 10 may also have a shape differing from that presented in the figures. Instead of a synchronizing shaft 10, it would thus be possible to use some other type of elongated element turnable about its fulcrum for synchronizing the motion of the stoppers, for example an elongated metal plate.

The invention claimed is:

1. An elevator comprising:

an elevator car;

car guide rails on one side of the elevator car;

an elevator shaft;

at least one stop block attached to one of the car guide rails and the elevator shaft;

at least two movable stop blocks attached to the elevator car; and a horizontal synchronizing element connecting the at least two movable stop blocks to synchronize motion of the at least two movable stop blocks, said element being oriented substantially in a direction parallel with the wall of the elevator car on the side of the car guide rails and defining a pivot axis, wherein the at least two movable stop blocks are pivotable about the pivot axis between a position (I) aligned with said at least one stop block and a position (II) away from said position (I) aligned with said at least one stop block.

2. An elevator according to claim 1, wherein the car guide rail includes two car guide rails disposed on one side of the elevator car, the at least one stop block includes two stop blocks, each one of said car guide rails having one of the two stop blocks.

3. An elevator according to claim 1, wherein the at least two movable stop blocks are arranged to be pivotable towards the car guide rails when moving into position (I) aligned with said at least one stop block and pivotable away from the car guide rails when moving into position (II) away from said position (I) aligned with said at least one stop block.

4. An elevator according to claim 1, wherein the horizontal synchronizing element is a shaft, and wherein each of the at least two movable stop blocks is turnable about a fulcrum, the at least two movable stop blocks are fixedly connected to each other by said shaft, and said fulcrums are aligned with said pivot axis.

5. An elevator according to claim 1, wherein the at least two movable stop blocks are turnable about a horizontal fulcrum.

6. An elevator according to claim 4, wherein the shaft is coaxial with the fulcrums of the at least two movable stop blocks.

7. An elevator according to claim 1, wherein the at least two movable stop blocks are disposed on the top of the elevator car.

8. An elevator according to claim 1, wherein the at least one stop block is attached to the car guide rails.

9. An elevator according to claim 1, wherein the at least two movable stop blocks are arranged to be turned into said position (I) aligned with said at least one stop block by a swiveling motion about said pivot axis.

10. An elevator according to claim 1, wherein the elevator car comprises a buffer placed to limit the pivot motion of the at least two movable stop blocks.

11. An elevator according to claim 1, wherein the at least two movable stop blocks are mounted on the elevator car such that the synchronizing element is between the elevator car and a wall of the elevator shaft.

12. An elevator according to claim 11, wherein the at least one stop block comprises a first stopper element (A) and a second stopper element (B), where the first and second stopper elements are movable relative to each other to allow adjustment of the mutual positions of the stopper elements.

13. An elevator according to claim 12, wherein the first stopper element (A) and the second stopper element (B) comprise form-locking surfaces.

14. An elevator according to claim 11, wherein the at least one stop block includes a pair of stop blocks and only one of the stop blocks is adjustable.

15. An elevator according to claim 1, wherein the at least one stop block comprises at least one adjustable stop block.

16. An elevator according to claim 13, wherein the at least one stop block comprises means for fastening the first stopper element (A) and the second stopper element (B) so as to make them immovable relative to each other.

17. An elevator according to claim 1, wherein at least one of the at least one stop block and the at least two movable stop blocks includes an impact damper element made of elastic material.

18. An elevator according to claim 1, further comprising elevator hoisting ropes that are disposed on the same side of the elevator shaft as the car guide rails.

19. An elevator according to claim 18, wherein at least part of the elevator hoisting ropes (R) are guided to pass via an area (A) which, in a first horizontal direction (X), is delimited between an outer wall ($W_C$) of the elevator car and a wall ($W_S$) of the elevator shaft and, in a second horizontal direction (Z), between the two guide rails of the elevator car.

20. An elevator according to claim 1, wherein the elevator car includes a car frame and the synchronizing element is mounted to be supported by the car frame.

* * * * *